US007965168B2

(12) United States Patent
Nicoletti, III

(10) Patent No.: US 7,965,168 B2
(45) **Date of Patent: *Jun. 21, 2011**

(54) FUSE DEVICE WITH INTEGRATED SWITCH

(75) Inventor: Leonard D. Nicoletti, III, Philadelphia, PA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/578,220

(22) Filed: Oct. 13, 2009

(65) Prior Publication Data

US 2010/0060405 A1 Mar. 11, 2010

Related U.S. Application Data

(62) Division of application No. 11/790,339, filed on Apr. 25, 2007, now Pat. No. 7,639,112.

(51) Int. Cl.
*H01H 85/08* (2006.01)
*H01H 85/044* (2006.01)
*H01H 71/20* (2006.01)

(52) U.S. Cl. ..... 337/167; 337/4; 337/143; 337/148; 337/159; 337/162

(58) Field of Classification Search ..... 337/3, 4, 337/143, 148, 162, 159, 167
See application file for complete search history.

(56) References Cited

U.S. PATENT DOCUMENTS 2,124,275 A 7/1938 Rowe
2,230,426 A 2/1941 Frank
2,313,365 A * 3/1943 Schultz ..... 337/170
2,566,720 A 9/1951 Dissinger
3,026,391 A * 3/1962 Bridges et al. ..... 337/417
3,032,629 A 5/1962 Uecker
3,614,700 A * 10/1971 Beard et al. ..... 337/203
3,849,610 A 11/1974 Lockard et al.
3,909,767 A 9/1975 Williamson et al.
4,092,504 A 5/1978 Kotaka
4,292,616 A 9/1981 Andersen
4,296,398 A 10/1981 McGalliard
4,380,001 A 4/1983 Kasamatsu
4,556,874 A 12/1985 Becker
4,658,101 A 4/1987 Akimoto et al.

(Continued)

FOREIGN PATENT DOCUMENTS

JP 04274120 A 9/1992

(Continued)

*Primary Examiner* — Anatoly Vortman

(74) *Attorney, Agent, or Firm* — Rader, Fishman & Grauer PLLC

(57) ABSTRACT

A fuse is provided that includes a housing and a first lead and a second lead. The fuse further includes a fuse element having a current capacity. The fuse element forms a part of an electrical pathway between the first lead and the second lead. The fuse also includes a switch unit in communication with the housing and in series with the fuse element. The switch unit has an open state and a closed state. When the switch unit is in the closed state, the electrical pathway is connected to form a closed pathway between the first lead and the second lead, and when the switch unit is in the open state, the electrical pathway is disconnected to provide an open circuit between the first lead and the second lead.

3 Claims, 5 Drawing Sheets

U.S. PATENT DOCUMENTS

| | | | | |
|---|---|---|---|---|
| 5,014,036 | A | 5/1991 | Komoto | |
| 5,237,302 | A | 8/1993 | Harris | |
| 5,473,495 | A | 12/1995 | Bauer | |
| 5,498,846 | A | 3/1996 | Chin | |
| 5,587,570 | A | 12/1996 | Kelaita, Jr. et al. | |
| 5,643,012 | A | 7/1997 | Mai et al. | |
| 6,474,197 | B1 * | 11/2002 | Browen et al. | 81/3.8 |
| 6,717,505 | B1 | 4/2004 | Bruchmann | |
| 6,773,307 | B2 | 8/2004 | Beer | |
| 6,791,047 | B1 | 9/2004 | Skarlupka et al. | |
| 6,833,519 | B1 | 12/2004 | Bruchmann | |
| 6,861,605 | B2 | 3/2005 | Wong | |
| 6,921,871 | B2 | 7/2005 | Nakazawa et al. | |
| 7,002,085 | B2 | 2/2006 | Ullmann et al. | |
| 7,319,199 | B1 | 1/2008 | Tuniewicz et al. | |
| 2006/0096775 | A1 | 5/2006 | Noest et al. | |
| 2006/0278504 | A1 | 12/2006 | Brojanac | |
| 2007/0272525 | A1 | 11/2007 | Suzuki | |

FOREIGN PATENT DOCUMENTS

| | | | |
|---|---|---|---|
| JP | 04274121 | A | 9/1992 |
| WO | WO-00/63940 | | 10/2000 |
| WO | WO-2005076301 | A1 | 8/2005 |

* cited by examiner

FUSE DEVICE WITH INTEGRATED SWITCH

CROSS REFERENCE TO RELATED APPLICATION

The present application is a Divisional Application of the patent application No. 11/790,339, filed Apr. 25, 2007, the entire contents of which are incorporated herein by reference.

BACKGROUND OF THE INVENTION

1. Field of the Invention

This invention relates generally to a fuse device.

2. Description of the Related Art

Electrical systems often include replaceable components such as fuses. Fuses generally protect circuit elements from electrical overloads. A conventional fuse includes a conductor, or fuse element, with a current rating. The current rating identifies the maximum amount of current that can pass through the fuse element without the fuse element melting or clearing. Once the fuse element melts or clears, the fuse no longer conducts electricity and must be replaced.

In conventional electrical systems, replaceable fuses are sometimes removed from a circuit to isolate components for debugging or other purposes. Often, replaceable fuses are hard to remove from a circuit.

A need exists to turn power off to certain components without having to remove a fuse or design circuits to include separate switches for isolation. There is a need to quickly isolate components to decrease debug and service time when a fuse is hard to remove. A need, therefore, exists to have a fuse to replace conventional fuses that can be turned off to shut down power to certain components without being removed.

SUMMARY OF THE INVENTION

The present invention provides a fuse with an integrated switch.

In one aspect, a fuse is provided. The fuse includes a housing and a first lead and a second lead. The fuse further includes a fuse element having a current capacity. The fuse element forms a part of an electrical pathway between the first lead and the second lead. The fuse also includes a switch unit in communication with the housing and in series with the fuse element. The switch unit has an open state and a closed state. When the switch unit is in the closed state, the electrical pathway is connected to form a closed pathway between the first lead and the second lead, and when the switch unit is in the open state, the electrical pathway is disconnected to provide an open circuit between the first lead and the second lead.

BRIEF DESCRIPTION OF THE DRAWINGS

These and other more detailed and specific features of the present invention are more fully disclosed in the following specification, reference being had to the accompanying drawings, in which.

Figure 1:
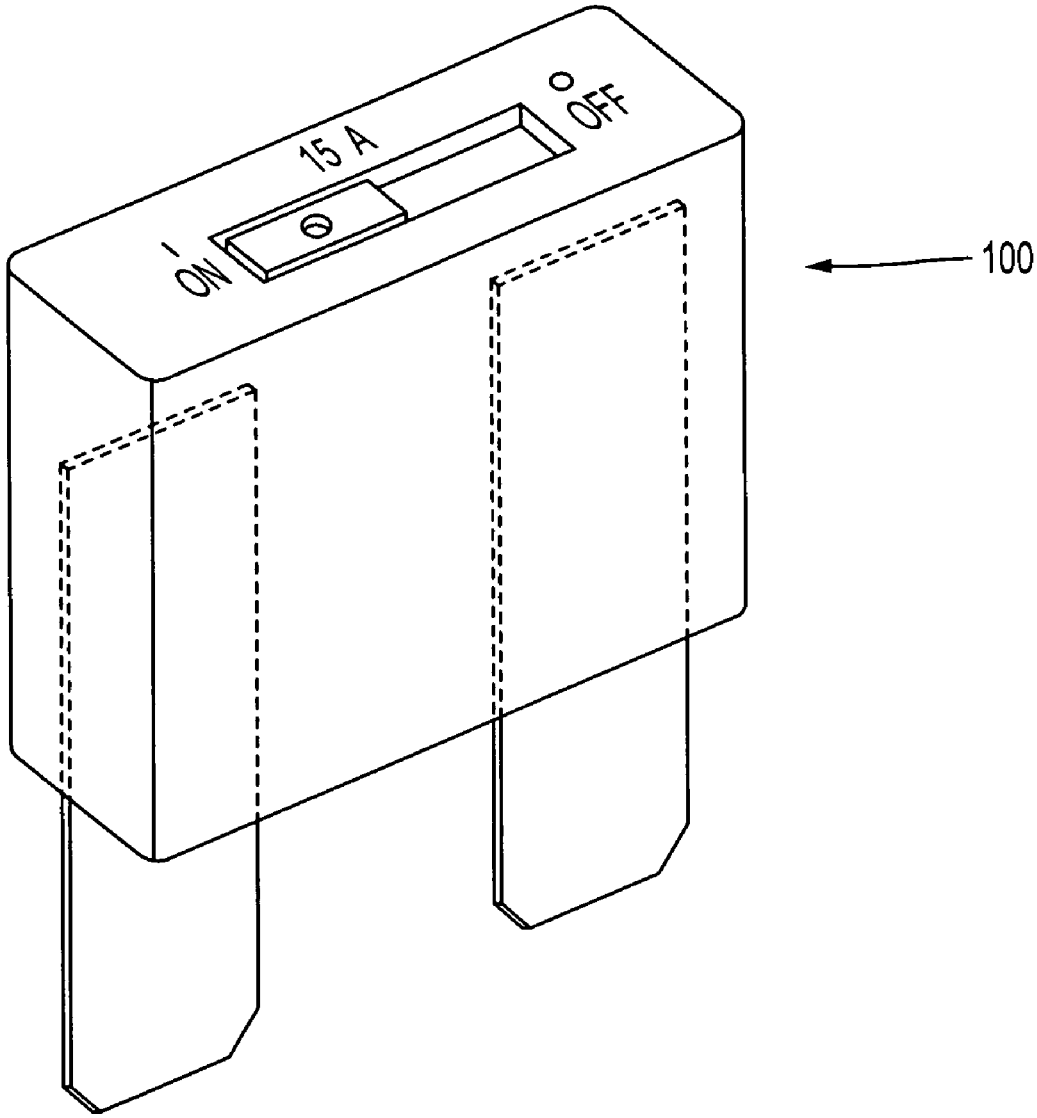
FIG. 1 is a perspective view of a fuse according to an embodiment of the invention.

It is noted that the drawings are not to scale. The drawings are merely schematic representations, not intended to portray specific parameters of the invention. The drawings are intended to depict only typical embodiments of the invention, and therefore should not be considered as limiting the scope of the invention. Embodiments of the invention will be described with additional specificity and detail through the accompanying drawings and description.

DETAILED DESCRIPTION OF THE INVENTION

In the following description, for purposes of explanation, numerous details are set forth in order to provide an understanding of one or more embodiments of the present invention. However, it is and will be apparent to one skilled in the art that these specific details are not required in order to practice the present invention, but that these specific details are for illustrative purposes only.

Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Embodiments of the invention provide a fuse with an integrated switch for turning the fuse on and off. This may be accomplished by integrating a switch unit in a fuse housing, the switch unit being in series with a fuse element. The first and second embodiments, below, are general examples of the invention utilizing different configurations of a sliding type switch. Although these examples are given, the invention is not limited to the configurations described herein. In other words, any configuration of a sliding type switch known to those having skill in the art may be implemented without departing from the scope or spirit of the invention. Moreover, other types of switches including, but not limited to, a toggle switch, a rocker switch, a push button switch, or a biased switch may be implemented using configurations known to those having skill in the art.

FIG. 1 is a perspective view of a fuse 100 implementing an embodiment of the invention. Fuse 100 may be any type of fuse including, but not limited to a blade type ATC fuse, an ATM series mini fuse, a fast acting ATO blade fuse, a surface mount fuse including a thin film chip fuse, a fast acting board fuse, a micro fuse, a radial lead fuse, an axial lead fuse, a fast acting wire in air subminiature fuse, a time delay fuse, a medium acting fuse, a glass fuse, a cartridge fuse, a ceramic fuse, a semiconductor fuse, or a thermal fuse.

Figure 2:
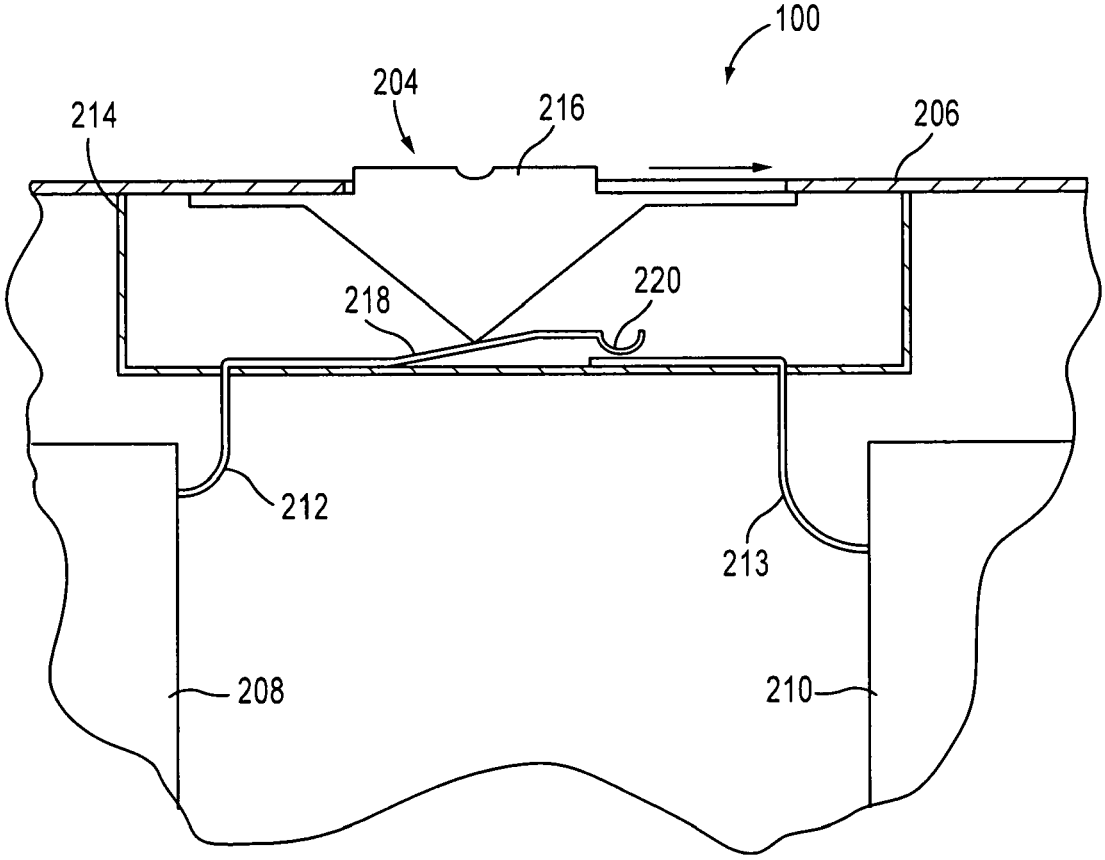
FIG. 2 is a side view of a fuse according to a first embodiment of the invention.

FIG. 2 demonstrates a side view of a first embodiment of fuse 100. Fuse 100 includes a switch unit 204 and a fuse housing 206. Switch unit 204 includes a switch housing 214. Switch housing 214 may be embedded in or integrated with fuse housing 206. Fuse housing 206 may have the same package dimensions as a conventional fuse. In other words, fuse 100 may be able to replace conventional fuses without having to redesign circuit layouts to compensate for fuse 100. As shown in FIG. 1, an upper surface of fuse hosing 206 may include status indicators to give reference to an "on" position and an "off" position of switch unit 204.

Fuse 100 also includes a first lead 208 and a second lead 210. A fuse element 212 is electrically connected to lead 208 and a fuse element 213 is electrically connected to lead 210. Fuse elements 212, 213 have current ratings as is understood by those having skill in the pertinent art in that the current ratings of fuse element 212 and fuse element 213 depend on intrinsic parameters such as width, thickness, and material compositions and external parameters such as temperature. Because the current rating depends on variable factors, the current rating for fuse element 212 and fuse element 213 has a tolerance range. Thus, it will be understood by those having skill in the art that as used in the description and throughout the claims, a current rating for a fuse element means that the fuse element will melt or clear if the current passing therethrough is approximately in the range of the current rating. Preferably, the current ratings for fuse element 212 and fuse element 213 are approximately the same, but may be different.

Switch unit 204 includes a moveable portion 216 and a switch lead 218. Switch lead 218 is provided on switch housing 214. Switch lead 218 is electrically connected to fuse element 212. Switch lead 218 has a current rating equal to or greater than the current ratings of fuse element 212 and fuse element 213. Switch lead 218 includes a contacting portion 220. Contacting portion 220 is in an overlapping relationship with fuse element 213. Alternatively, instead of being in an overlapping relationship itself, fuse element 213 may be electrically connected to a second switch lead that is an overlapping relationship with contacting portion 220. Additionally, switch lead 218 and fuse element 212 may be integrated into a single conductive fuse element. Moreover, fuse 100 may include only one of fuse elements 212 and 213 with the other being replaced with an electrically conductive lead.

Next, operation of fuse 100 will be described. Fuse 100 may be provided in an electrical circuit. Moveable portion 216 may be moved to an "on" closed circuit position as indicated by the arrow. Moveable portion 216 may also be in an "off" open circuit position as shown in FIG. 2. It is preferable that when moveable portion 216 is in the "on" or "off" position, moveable portion 216 is firm or secure in the "on" or "off" position so as to prevent unwanted movement of moveable portion 216. When moveable portion 216 is in the closed circuit position, moveable portion 216 provides a force to switch lead 218 so that contacting portion 220 comes into contact with fuse element 213. When contacting portion 220 is in contact with fuse element 213, an electrical pathway between first lead 208 and second lead 210 is complete to allow current to flow between and through first lead 208 and second lead 210. When moveable portion 216 is in the closed circuit position, fuse 100 acts as a fuse in that if current passing between first lead 208 and second lead 210 exceeds the current rating of fuse element 212 and/or fuse element 213, fuse element 212 and/or fuse element 213 will melt or clear thus providing an open circuit.

If moveable portion 216 is moved from the closed circuit position to the open circuit position, a restoring force of switch lead 218 will cause switch lead 218 to move thereby disconnecting contacting portion 220 from fuse element 213. An open circuit is therefore created between first lead 208 and second lead 210 regardless whether fuse element 212 and/or 213 has not melted or cleared.

Having a fuse according to the first embodiment eliminates the need to remove a fuse or add a switch somewhere else in a circuit. Moreover, a fuse according to the first embodiment may simplify and decrease service time of existing electrical components. For example, a fuse according to the first embodiment may be advantageous in that components can be electronically isolated for quick debugging and service in the situation where the fuse is hard to remove. Instead of removing the fuse, the switch unit can be moved to the open circuit state to isolate components.

Figure 3:
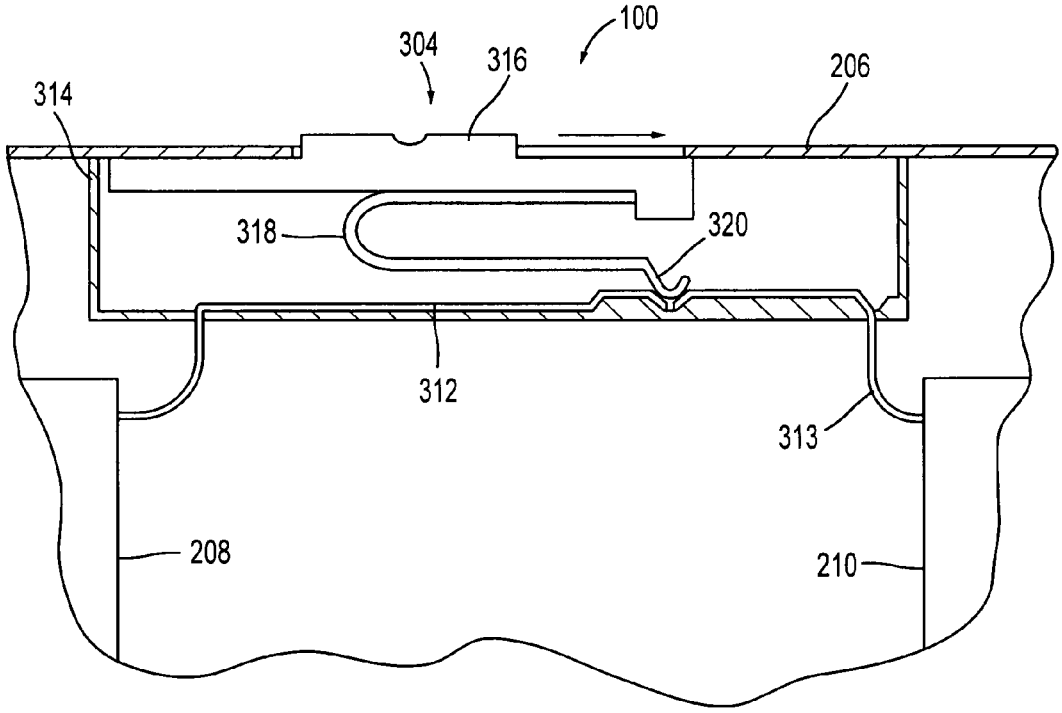
FIG. 3 is a side view of a fuse according to a second embodiment of the invention.

FIG. 3 demonstrates a side view of a second embodiment of fuse 100. Similar to the first embodiment, fuse 100 includes a switch unit 304 and a fuse housing 206. Switch unit 304 includes a switch housing 314. Switch housing 314 may be embedded in or integrated with fuse housing 206. Fuse housing 206 may have the same package dimensions as a standard fuse. In other words, fuse 100 may be able to replace conventional fuses without having to redesign circuit layouts to compensate for fuse 100. As shown in FIG. 1, an upper surface of fuse hosing 206 may include status indicators to give reference to an "on" position and an "off" position of switch unit 304.

Fuse 100 also includes a first lead 208 and a second lead 210. A fuse element 312 is electrically connected to lead 208 and a fuse element 313 is electrically connected to lead 210. Fuse elements 312, 313 have current ratings as described with reference to the first embodiment. Alternatively, fuse 100 may include only one of fuse elements 312 and 313 with the other being replaced with an electrically conductive lead.

Switch unit 304 includes a moveable portion 316 and a switch lead 318. Switch lead 318 is in communication with moveable portion 316. Switch lead 318 has a current rating equal to or greater than the current ratings of fuse element 312 and fuse element 313. Switch lead 318 includes a contacting portion 320.

Next, operation of fuse 100 will be described. Fuse 100 may be provided in an electrical circuit. Moveable portion 316 may be moved into an "on" closed circuit position as shown in FIG. 3. Moveable portion 316 may also be moved to an "off" open circuit position as indicated by the arrow. It is preferable that when moveable portion 316 is in the "on" or "off" position, moveable portion 316 is firm or secure in the "on" or "off" position so as to prevent unwanted movement of moveable portion 316. When moveable portion 316 is moved to the closed circuit position, switch lead 318 also moves so that contacting portion 320 comes into contact with both fuse element 312 and fuse element 313. When contacting portion 320 is in contact with fuse elements 312 and 313, an electrical pathway between first lead 208 and second lead 210 is complete to allow current to flow between and through first lead 208 and second lead 210. When moveable portion 316 is in the closed circuit position, fuse 100 acts as a fuse in that if current passing between first lead 208 and second lead 210 exceeds the current rating of fuse element 312 and/or fuse element 313, fuse element 312 and/or fuse element 313 will melt or clear thus providing an open circuit.

If moveable portion 316 is moved from the closed circuit position to the open circuit position, switch lead 318 also moves and causes contacting portion 320 to disconnect from fuse element 312. An open circuit is therefore created between first lead 208 and second lead 210 regardless whether fuse element 312 and/or 313 has not melted or cleared.

Having a fuse according to the second embodiment eliminates the need to remove a fuse or add a switch somewhere else in a circuit. Moreover, a fuse according to the second embodiment may simplify and decrease service time of existing electrical components. For example, a fuse according to the second embodiment may be advantageous in that components can be electronically isolated for quick debugging and service in the situation where the fuse is hard to remove. Instead of removing the fuse, the switch unit can be moved to the open circuit state to isolate components.

Although the switch units 204 and 304 of the first and second embodiments include a sliding type switch, other switch types may be used. For example, a toggle type switch, a rocker type switch, a push button type switch, or a biased type switch may also be implemented without departing from the scope and spirit of the invention. Furthermore, instead of integrating a switch unit with a fuse housing as in the first and second embodiment, a switch unit may be provided on a fuse block, fuse clip, or fuse holder.

Figure 4:
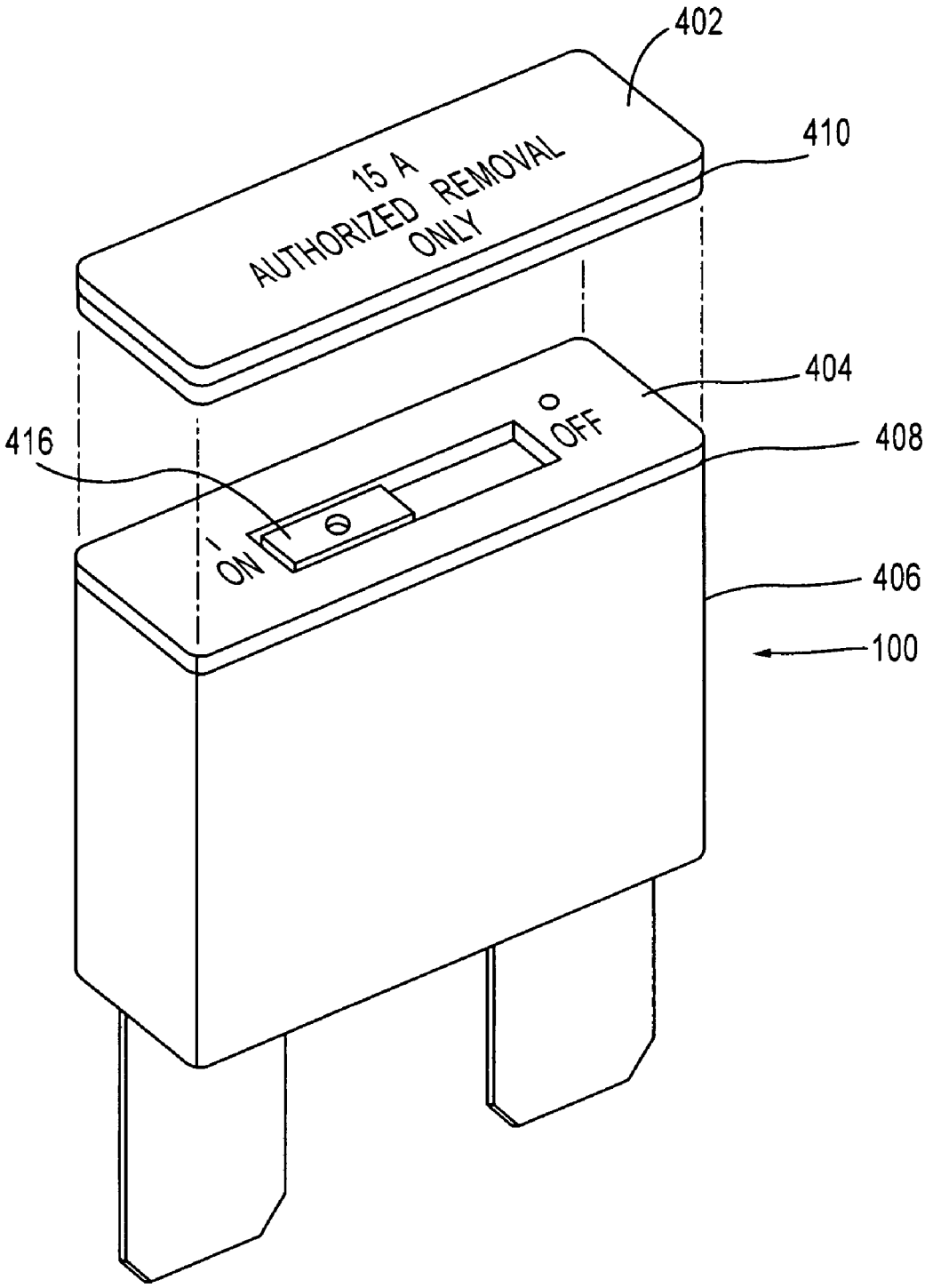
FIG. 4 is a perspective view of a fuse according to a third embodiment of the invention.

Next, a feature of the invention will be discussed with reference to FIG. 4. FIG. 4 includes a fuse 100. Fuse 100 may include a sliding type switch according to the first or second embodiment, or may include a sliding type switch implementing any configuration known to those having skill in the art. Alternatively, fuse 100 may include a toggle switch, a rocker switch, a push button switch, a biased switch, or any other switch known to those having skill in the art.

The feature also includes a fuse cover 402. The dimensions of fuse cover 402 may be arranged so that fuse cover 402 fits over a top surface 404 of fuse housing 406. Fuse housing 406 may include a grooved portion 408 on upper portions of its side surfaces. Fuse cover 402 may include an attaching portion 410 on inner portions of its side surfaces.

When fuse cover 402 is placed over top surface 404, attaching portion 410 engages with grooved portion 408 so that fuse cover 402 remains secure over top surface 404. Upon removal, a force applied to fuse cover 402 disengages attaching portion 410 from grooved portion 408. Fuse cover 402 may be engaged and disengaged with fuse 100 multiple times without deterioration of attaching portion 410 and grooved portion 408. While engaged with fuse 100, fuse cover 402 may prevent accidental switching of a moveable portion 416 from an "on" position to an "off" position by a person who is not familiar with the operation of fuse 100. In other words, fuse cover 402 may prevent someone from accidentally causing an open circuit and mistaking fuse 100 or other components as non-functioning.

Figure 5A:
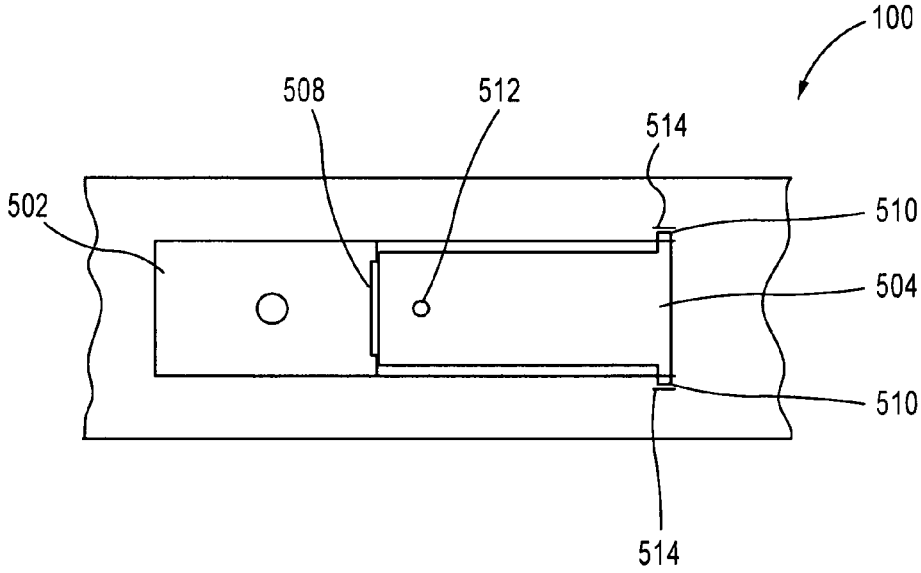
FIG. 5(*a*) is a top view of a fuse according to a fourth embodiment of the invention, and FIG. 5(*b*) is a side view of the fuse of the fourth embodiment.
Figure 5B:
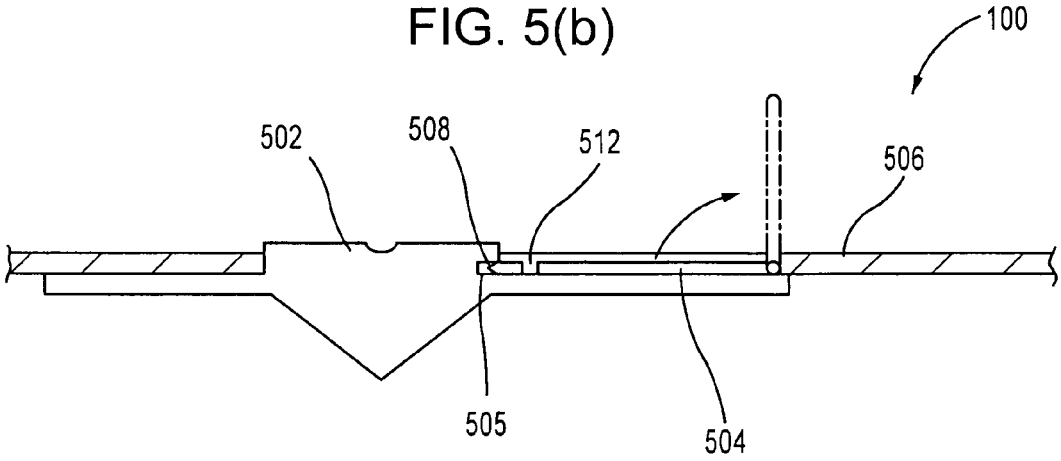

Next, another feature of the invention will be described. FIG. 5(*a*) is a top view of a fuse 100 and FIG. 5(*b*) is a side view of fuse 100. Fuse 100 may include a sliding type switch according to the first or second embodiment, or may include a sliding type switch implementing any configuration known to those having skill in the art.

A tip portion of engaging portion 508 may be beveled so that engaging portion 508 may be engaged and disengaged with notch 505. Tab 504 may prevent moveable portion 502 from moving when engaging portion 508 is engaged with notch 505. In operation, moveable portion is in an "on" position so that fuse 100 is in a short circuit state. Engaging portion 508 is engaged with notch 505 which prevents moveable portion 502 from moving to an "off," or open circuit, position. To switch fuse 100 to an open circuit state, access portion 512 may be used to disengage engaging portion 508 from notch 505. For example, an object, such as tweezers, may be inserted into access portion 512 and a force applied so that engaging portion 508 is disengaged from notch 505 while tab 504 pivots about pivot portions 510. Thereafter, moveable portion 502 may be moved to an "off" position. Engaging portion 508 may be engaged with and disengaged from notch 505 multiple times without deterioration of engaging portion 508 and notch 505.

While engaged with notch 505, tab 504 may prevent accidental switching of moveable portion 502 from an "on" position to an "off" position by a person who is not familiar with the operation of fuse 100. In other words, tab 504 may prevent someone from accidentally causing an open circuit and mistaking fuse 100 or other components as non-functioning.

It will be obvious to those having skill in the art that a fuse of the invention may be included in an electrical system with components that have a current rating higher than the current rating of the fuse. For safety measures, components of an electrical system that includes the present invention may have a current rating of at least two times the current rating of the fuse. Moreover, when designing an electrical system that includes a fuse of the present invention, the environment where the system will be used, such as exposure to moisture, vibration, high current, temperatures, chemicals, ultra violet, and so forth may be taken into consideration.

The skilled artisan will recognize that various combinations of types of fuses and types of switches may be implemented for various applications or uses. The skilled artisan will also recognize that some combinations of types of fuses and types of switches may not be practical for certain applications or uses do to factors such as safety. For example, implementing the invention using a toggle switch or a rocker switch for use in a computer may be more practical than for use in an automobile.

Although the present invention has been described in considerable detail with reference to certain embodiments thereof, the invention may be variously embodied without departing from the spirit or scope of the invention. Therefore, the following claims should not be limited to the description of the embodiments contained herein in any way.

What is claimed is:

1. A fuse, comprising:

a housing;

a first lead and a second lead;

a fuse element having a current capacity and forming a part of an electrical pathway between the first lead and the second lead, the fuse element having a first fuse element portion in electrical communication with the first lead and a second fuse element portion in electrical communication with the second lead and disposed adjacent to yet spaced apart from the first fuse element portion; and a switch unit slidably connected to the housing and including a moveable portion, a switch lead associated with the moveable portion and connected at a proximal end to one of the first and second fuse element portions and an electrically-conductive contacting portion connected to a distal end of the switch lead, the switch unit moveable between an electrically-disconnected open state and an electrically-conductive closed state, wherein the switch lead is resiliently biased in contact with the movable portion such that, in the electrically-disconnected open state, the moveable portion is in an OFF position and the electrically-conductive contacting portion is spaced apart from a remaining one of the first and second fuse element portions and, in the electrically-conductive closed state, the moveable portion slidably moves relative to the housing and along the switch lead from the OFF position to an ON position and the electrically-conductive contacting portion is urged by the movable portion into electrical contact with the remaining one of the first and second fuse element portions.

2. The fuse according to claim 1, wherein the switch unit is a toggle switch.

3. The fuse according to claim 1, wherein the switch unit is provided on a fuse block, a fuse clip, or a fuse holder.

* * * * *